United States Patent [19]

Garrison et al.

[11] 4,252,309

[45] Feb. 24, 1981

[54] DOCUMENT SHEET FLIPPER

[75] Inventors: Stephen P. Garrison, Austin; Elmer L. B. Kroeker, Round Rock, both of Tex.

[73] Assignee: International Business Machines Corporation, Armonk, N.Y.

[21] Appl. No.: 53,651

[22] Filed: Jun. 29, 1979

[51] Int. Cl.[3] ..... B65H 29/02

[52] U.S. Cl. ..... 271/186; 271/82; 271/277

[58] Field of Search ..... 271/186, 187, 314, 315, 271/178, 82, 277, 69

[56] References Cited

U.S. PATENT DOCUMENTS

| | | | |
|---|---|---|---|
| 3,075,760 | 1/1963 | Frederick . | |
| 3,663,014 | 5/1972 | Wasylenko | 271/82 |
| 3,904,192 | 9/1975 | Pfeifer et al. | 271/186 |
| 4,027,580 | 6/1977 | Sundin | 271/69 |
| 4,111,119 | 9/1978 | Takizawa et al. | 271/277 |

*Primary Examiner*—Robert B. Reeves
*Assistant Examiner*—Brian Bond
*Attorney, Agent, or Firm*—John W. Henderson, Jr.

[57] ABSTRACT

Apparatus for flipping document sheets such as paper or the like from one side to the other such that the document sheets may be stacked in a hopper in sequenced order after printing or copying on one side or used for printing or copying on both sides. The apparatus includes at least one rotatable cylindrical member having tapered slots disposed therein 180 degrees apart for receiving the leading edge of the sheet to be flipped, and a clamping member which permits the slots to remain open during the sheet insertion, clamp the sheet during rotation of the cylindrical member, and again permits the slots to open at the release point such that the flipped sheet may be released. The location and angle of the slots in the cylindrical member are such the initial force for rotating the cylindrical member is imparted thereto by the entry of document sheet into the slot.

3 Claims, 2 Drawing Figures

DOCUMENT SHEET FLIPPER

BACKGROUND OF THE INVENTION

1. Field of the Invention

This invention relates generally to sheet feeding machines and more particularly to apparatus for feeding and positioning a document such that the sides of the document are reversed.

2. Description of the Prior Art

Prior art devices for flipping document sheets from one side to the other are generally mechanically cumbersome and/or unreliable. Many of these devices require a plurality of endless drive belts and associated drive pulleys for moving and bending the document sheets to conform to the desired feed path. Other devices utilize spring loaded arms about the periphery of a roller to grip the edge of the document sheet. These devices frequently require extensive mechanical adjustment to produce the proper spring tension for engaging and releasing the document sheets.

SUMMARY OF THE INVENTION

The present invention provides a simple and efficient structure for flipping document sheets which comprises a rotatable cylindrical transferring member having receiving slots therein for receiving the leading edge of the document sheet to be flipped over, a clamp for closing the receiving slots to retain the edge of the sheet during a portion of the rotation of the cylindrical member, with the clamp being designed to open the receiving slot when the slot is in the document sheet receiving position and when the cylindrical member has been rotated to the document sheet release position, the cylindrical member being freely rotatable and the slot designed such that the force of the entry of the document sheet into the slot initiates rotation of the cylindrical member and with supplemental force to rotate the cylindrical member through 180 degrees being supplied by a feed roller.

DESCRIPTION OF THE PREFERRED EMBODIMENT

Figure 1:
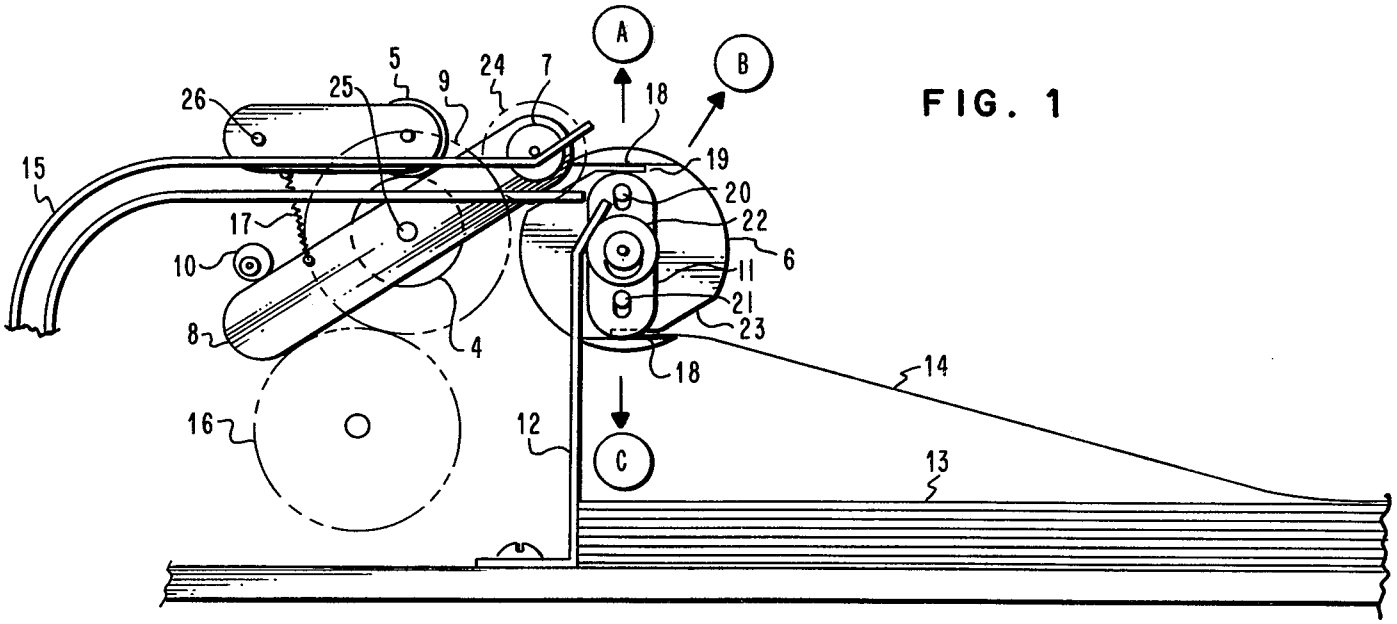
FIG. 1 is a side diagrammatic view of document sheet flipper mechanism with associated feed path and rollers and output hopper.
Figure 2:
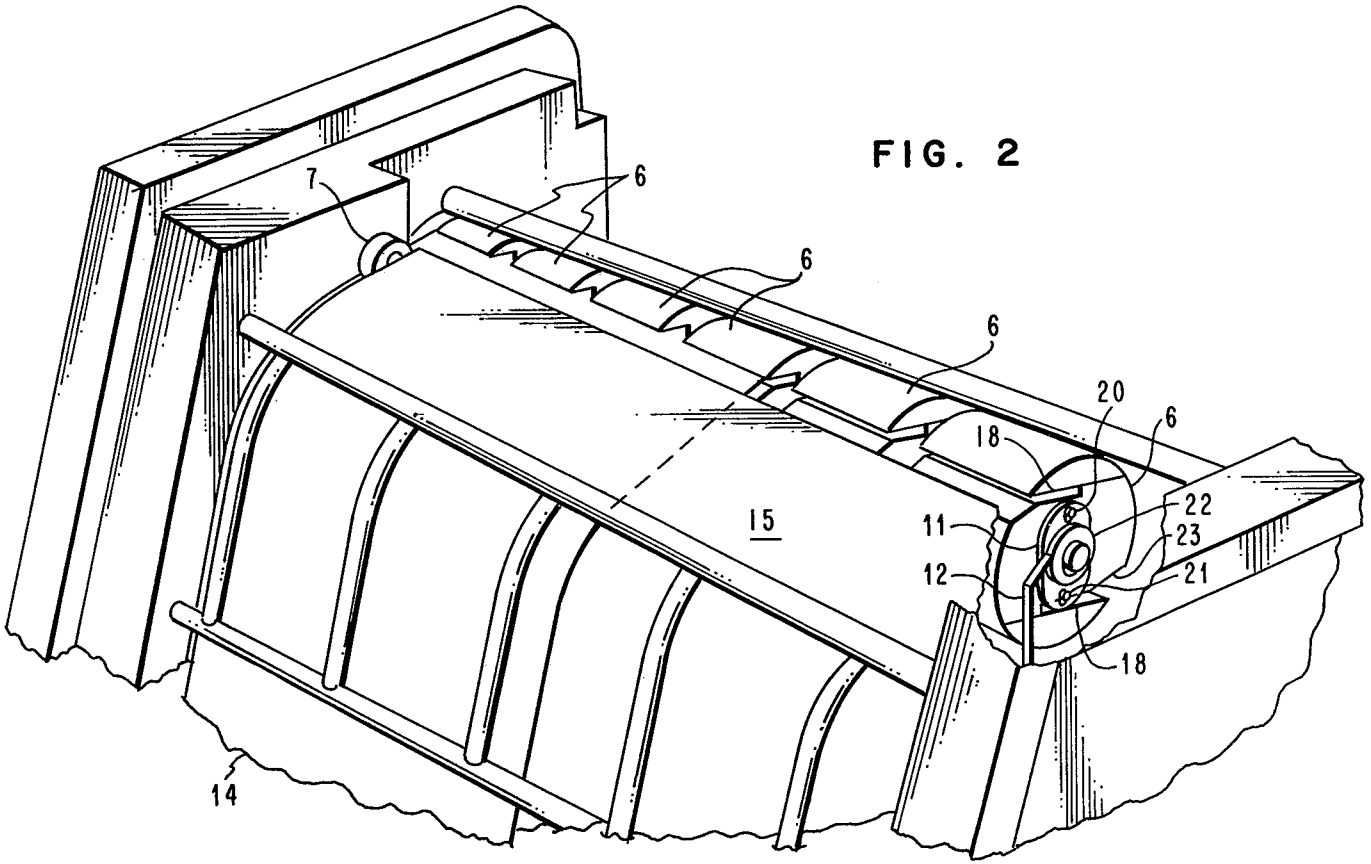
FIG. 2 is a front diagrammatic view of the document sheet flipper mechanism.

FIGS. 1 and 2 show diagrammatically the preferred embodiment of the apparatus according to the invention. A paper feed path 15 is mounted for receiving a document to be flipped from the output of a printing device or copier (not shown). The paper feed path 15 may be constructed as a wire mesh rack or of solid material such as sheet metal or plastic. A sheet to be flipped enters the left side of the paper path 15 and is engaged by drive roller 4 and idler roller 5. Drive roller 4 and idler roller 5 may be continuous cylindrical rollers of length equal to or less than the width of paper path 15. Although in the preferred embodiment drive roller 4 and idler roller 5 are a pair of single rollers, drive roller 4 and idler roller 5 may be composed of multiple cylindrical rollers mounted end-to-end and spaced apart on a shaft which spans the width of the paper path 15. Drive roller 4 is mounted concentrically with gear 9 on shaft 25. The force for driving drive roller 4 is imparted to shaft 25 from gear 9 in response to main drive 16. Main drive 16 may be a gear mounted on the shaft of an electric motor or may receive its driving impetus from other sources in the system not shown.

Idler roller 5 is spring biased into the drive roller 4 by spring 17 which has one end attached to the arm supporting the shaft on which idler roller 5 is mounted. The idler roller arm is pivotably attached at 26. The drive roller 4 in conjunction with idler roller 5 provide for transport of the paper into the flipper roller 6.

The flipper roller 6 likewise is composed of a number of cylindrical rollers mounted end-to-end and spaced apart on a shaft. Each flipper roller 6 has two tapered slots 19 180 degrees apart into which the edge of the document sheet is driven. The slots 19 each has a sloped surface 23 at the opening which acts as a cam surface to guide the edge of the document sheet into the slot. The tapered slots 19 are devised and constructed in the body of the flipper rollers 6 such that force exerted against the closed end of the slot 19 is equivalent to imparting a force tangential to the surface of the flipper rollers 6 such that rotation thereof is induced. The flipper rollers 6 are fixedly attached to a shaft which is free to rotate and normally occupy the position designated by A. Alternatively, the shaft may be fixedly attached with the rollers free to rotate on the shaft.

A feed roller 7 is mounted on a shaft adjacent the flipper rollers 6 and supported by a pivot arm 8. The pivot arm 8 is free to rotate about the drive roller shaft 25. The feed roller 7 is driven by gear 24 which engages the drive roller gear 9. The ratio of the feed roller gear 24 and the drive roller gear 9 is selected such that the surface speed of the feed roller 7 is the same as or slightly slower than the surface speed of the drive roller 4. The feed roller 7 is spring biased into the flipper rollers 6 by spring 17 but is restrained from engaging the sloped surface 23 of the flipper rollers 6 by the eccentric stop 10. In the preferred embodiment the feed roller 7 is a single cylindrical roller of adequate length to engage all flipper rollers 6. However the feed roller 7 could be constructed of a plurality of rollers mounted end-to-end adjacent each of the flipper rollers 6.

A document sheet edge clamp 11 is slidably attached to the end of each flipper roller 6 by pins 20 and 21. The clamp 11 has elongated slots through which the pins 20 and 21 and the flipper roller shaft pass and is free to slide up and down on the pins 20 and 21 until its motion is stopped by either of the two ledges 18 that extend from the outer edge of the slots 19.

A flat spring 12 is mounted such that its angular end presses against the round cam surface 22 projecting from each clamp 11 and tends to toggle the clamp about the pins 20 and 21. The flat spring 12 also acts as a front wall for the output hopper 13 and tends to disengage the edge of the document sheet 14 from flipper roller slot 19 once the flip over is accomplished.

In operation, a document sheet 14 enters the feed path 15 and is engaged by the combination of the drive roller 4 and idler roller 5. The flipper rollers 6 are positioned at A and drive roller 4 forces the sheet 14 into the tapered slot 19 of the flipper rollers 6. When the edge of the sheet 14 is driven completely into the slot 19, continued force by the drive roller 4 on the sheet 14 forces the flipper rollers 6 to rotate to position B. As the flipper rollers 6 reach position B the feed roller 7 engages the outer surface of the flipper rollers 6 with the document sheet 14 in between. The feed roller 7 drives the flipper rollers 6 and the document sheet 14 around to position C. Also in position B the clamp 11 is toggled out and up by the angular end of the flat spring 12 to clamp the edge of the document sheet 14 against the ledge 18, thus securing the document sheet 14 in the slot 19.

As position C is reached, the feed roller 7 loses contact with the flipper rollers 6 because the tapered surface 23 comes adjacent to the feed roller 7 and eccentric stop 10 inhibits the motion of arm 8. The flipper rollers 6 stop at position C but drive roller 4 continues to drive the document sheet 14 until the trailing edge passes through the drive roller 4 and past the clamped leading edge. The document sheet 14 is now positioned with the leading edge clamped in the slot 19 of the flipper rollers 6 and the rest of the sheet on the outer hopper stack.

When the drive roller 4 drives the leading edge of the next sheet into the second slot 19 and the flipper rollers 6 begin to rotate, the flat spring 12 urges the clamp 11 upward to engage the second sheet and correspondingly disengages the clamp from the sheet in the output hopper 13. Concurrently the leading edge of the sheet in the output hopper abuts against the flat spring 12 which removes it from the slot 19 in the flipper roller 6. This operation is repeated for each sheet that enters the mechanism to be flipped.

While there has been described what is considered to be the preferred embodiment of the present invention, it will be obvious to those skilled in the art that variations and modifications may be made to the invention. The appended claims are intended to cover those variations and modifications which do not depart from the spirit and scope of the invention.

What is claimed is:

1. Sheet flipping apparatus comprising:

a rotatable transferring member having receiving means for receiving the leading edge of the sheet to be turned over, and clamp means for closing said receiving means to retain said sheet edge during at least a portion of the rotation of said rotatable member, said clamp means including an elongated plate flat on one side with a rounded cam surface on the other side, slidably attached to the end of said rotatable transferring member, a ledge protruding from the periphery of said receiving means, and a spring member biased against the cam surface of said plate such that said plate is forced into a position closing said receiving means during rotation of said transferring member and forced into a position opening said receiving means when said transferring member is in said sheet receiving position or said sheet release position; and means for rotating said transferring member from said sheet receiving position for substantially 180 degrees to said sheet release position.

2. The apparatus of claim 1 wherein said means for rotating said transferring member includes driving means which feed the sheet to be turned-over into said receiving means, the driving force being imparted to said transferring member directly through the sheet.

3. The apparatus of claim 1 or claim 2 wherein said receiving means is a slot integral to said rotatable transferring member located such that the application of force to the closed end of the slot is equivalent to applying force tangentially to the surface of said rotatable transferring member.

* * * * *